US006898823B2

(12) United States Patent
Tsai

(10) Patent No.: US 6,898,823 B2
(45) Date of Patent: May 31, 2005

(54) SINGLE-TUBE RETRACTABLE HANDLE ASSEMBLY

(76) Inventor: James Tsai, No. 103, Ta-Ming 1 Rd., Tung Pao Village, Tan Tzu Hsian, Taichung Hsien (TW)

( * ) Notice: Subject to any disclaimer, the term of this patent is extended or adjusted under 35 U.S.C. 154(b) by 6 days.

(21) Appl. No.: 10/623,554

(22) Filed: Jul. 22, 2003

(65) Prior Publication Data

US 2005/0015932 A1 Jan. 27, 2005

(51) Int. Cl.[7] ..... B25G 1/04; A45C 3/00

(52) U.S. Cl. ..... 16/405; 16/113.1; 16/429; 190/115

(58) Field of Search ..... 16/405, 113.1, 16/429; 190/18 A, 115; 280/655.1, 655, 47.371, 47.17, 47.315

(56) References Cited

U.S. PATENT DOCUMENTS 5,048,649 A * 9/1991 Carpenter et al. ..... 190/18 A
5,197,579 A * 3/1993 Bieber et al. ..... 190/18 A
5,353,900 A * 10/1994 Stilley ..... 190/18 A
5,464,080 A * 11/1995 Liang ..... 190/18 A
5,547,053 A * 8/1996 Liang ..... 190/115
5,813,504 A * 9/1998 Iny et al. ..... 190/116
6,202,254 B1 * 3/2001 Ezer ..... 16/113.1
6,279,706 B1 * 8/2001 Mao ..... 190/115
6,425,599 B1 * 7/2002 Tsai ..... 280/652
6,434,790 B1 * 8/2002 Chen ..... 16/113.1

FOREIGN PATENT DOCUMENTS

WO WO 3020069 A1 * 3/2003 ..... A45C/5/14

* cited by examiner

*Primary Examiner*—Chuck Y. Mah
(74) *Attorney, Agent, or Firm*—Bacon & Thomas, PLLC

(57) ABSTRACT

A retractable handle assembly for a luggage, handcart and the like comprises a retractable tube having four tubes engaged with each other, three controllers received in the tubes and a tube plug having engagement portion provided at an end of the retractable tube. A handle has a grip portion, an axle portion and a handle plug having an engagement portion provided at an end of the axle portion. The handle is pivotally coupled with the retractable tube by a shaft. A lock device is movably mounted on the retractable handle assembly. The lock device is moved between a first position, in which the lock device is engaged with both of the engagement portions of the retractable tube and the handle, and a second position, in which the lock device only is engaged with one of the engagement portions of the retractable tube and the handle.

15 Claims, 8 Drawing Sheets

SINGLE-TUBE RETRACTABLE HANDLE ASSEMBLY

BACKGROUND OF THE INVENTION

1. Field of the Invention

The present invention relates to a carrying tool, and more particularly to a single-tube handle assembly of a luggage, a handcart and the like.

2. Description of the Related Art

FIG. 1 shows a conventional luggage 200, which comprises a case 210, two wheel assemblies 220 installed at the bottom of the case 210, and a retractable handle 230 at the top of the case 210. The retractable handle 230 has two retractable tubes 232 and 234 and a handle bar 236 connected with distal ends of the retractable tubes 232 and 234. The retractable tubes 232 and 234 have controllers (not shown) therein to control the retractable tubes 232 and 234 being elongated and retracted.

The conventional retractable handle 230 has a larger size so that it will take a larger space in the case 210 and make the luggage heavier. The conventional retractable handle 230 also has a higher cost to manufacture them, and more particularly, they cannot attract consumers' attention to buy the luggage anymore.

SUMMARY OF THE INVENTION

The primary objective of the present invention is to provide a single-tube retractable handle assembly for a luggage, which has smaller size, lighter weight and lower cost.

According to the objective of the present invention, a retractable handle assembly comprises a retractable tube having two or more tubes engaged with each other and at least a controller received in the tube, wherein an engagement portion is provided at an end of the retractable tube. A handle has a grip portion and an axle portion, wherein an engagement portion is provided at an end of the axle portion. The handle is pivoted on the retractable tube with the engagement portion of the handle corresponding to the engagement portion of the retractable tube, and a lock device is movably mounted on the retractable handle assembly at where a junction between the retractable tube and the handle. The lock device is moved between a first position, in which the lock device is engaged with both of the engagement portions of the retractable tube and the handle, and a second position, in which the lock device only is engaged with one of the engagement portions of the retractable tube and the handle.

DETAILED DESCRIPTION OF THE INVENTION

Figure 1:
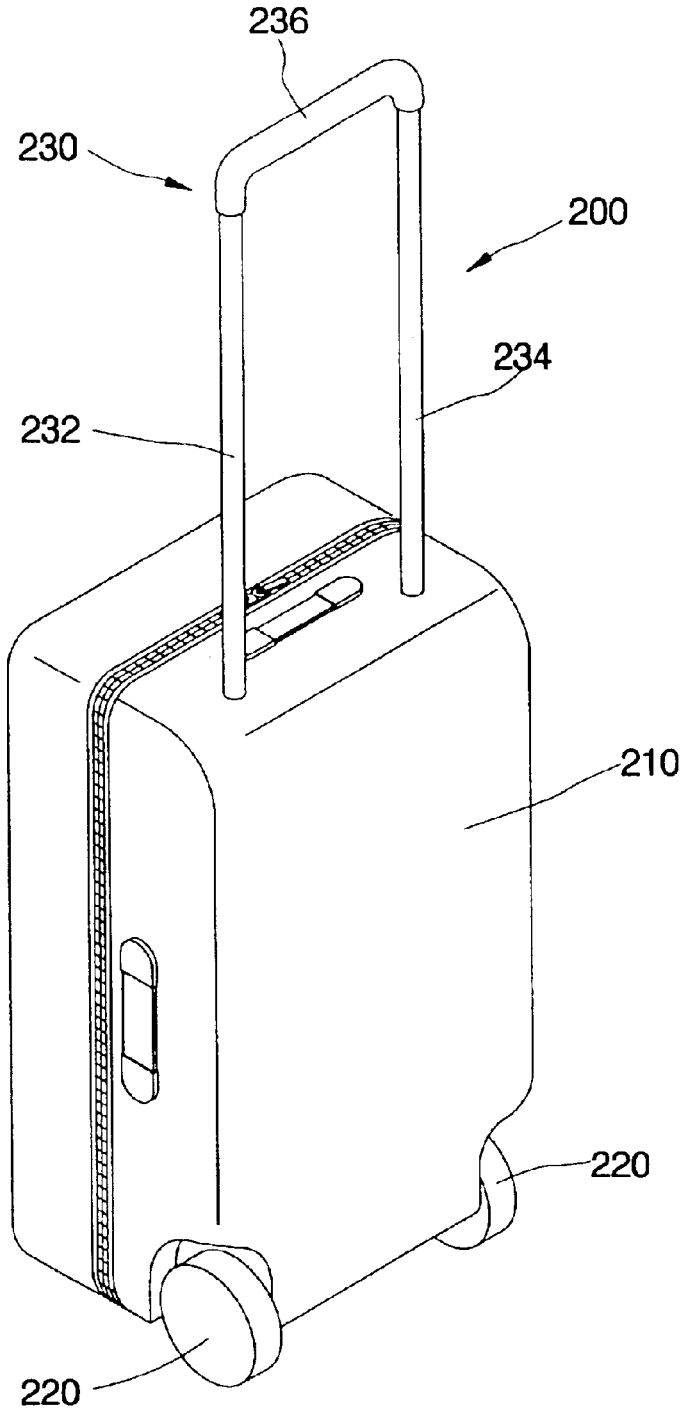
FIG. 1 PRIOR ART
FIG. 1 is a perspective view of a conventional luggage.
Figure 2:
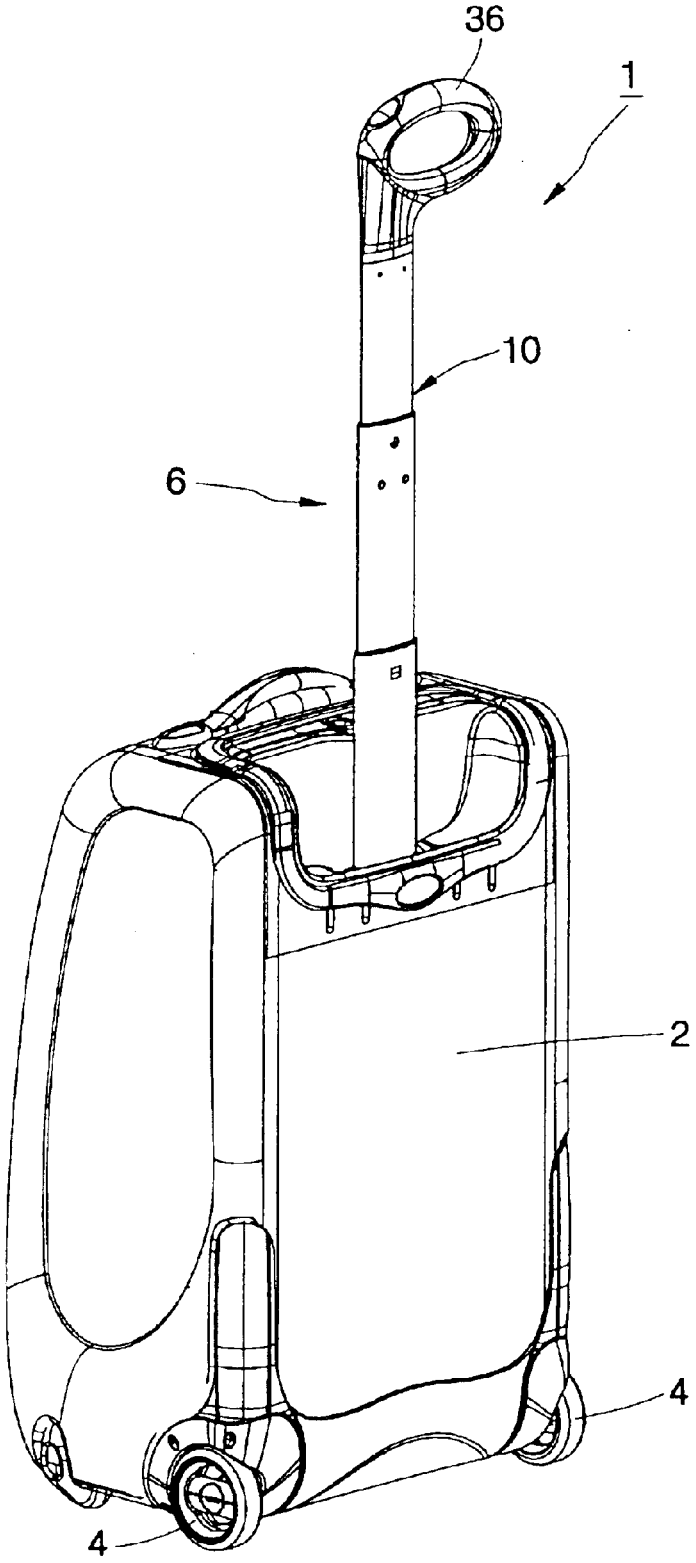
FIG. 2 is a perspective view of the luggage of a preferred embodiment of the present invention.
Figure 3:
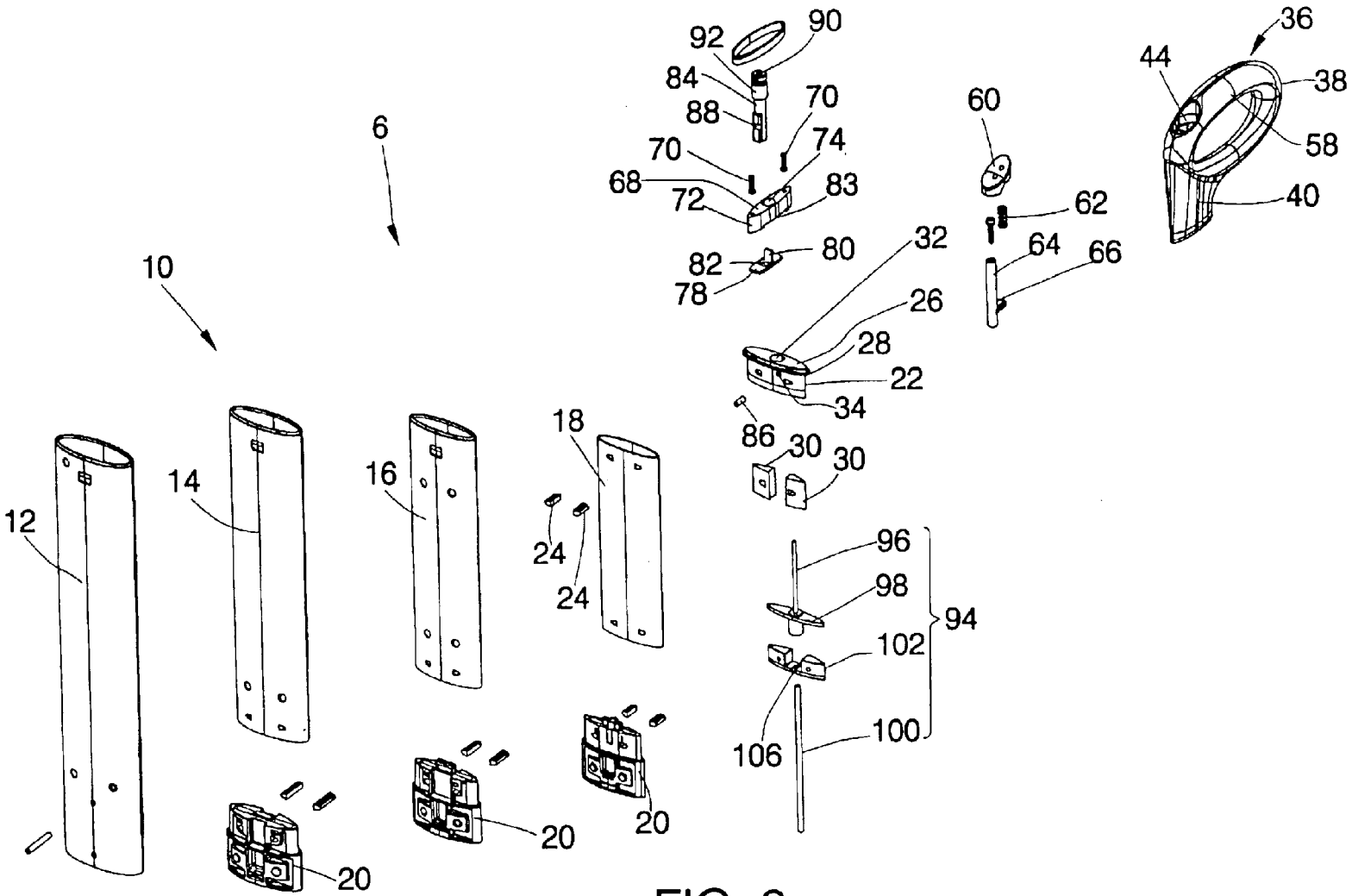
FIG. 3 is an exploded view of the retractable handle of the preferred embodiment of the present invention.
Figure 4:
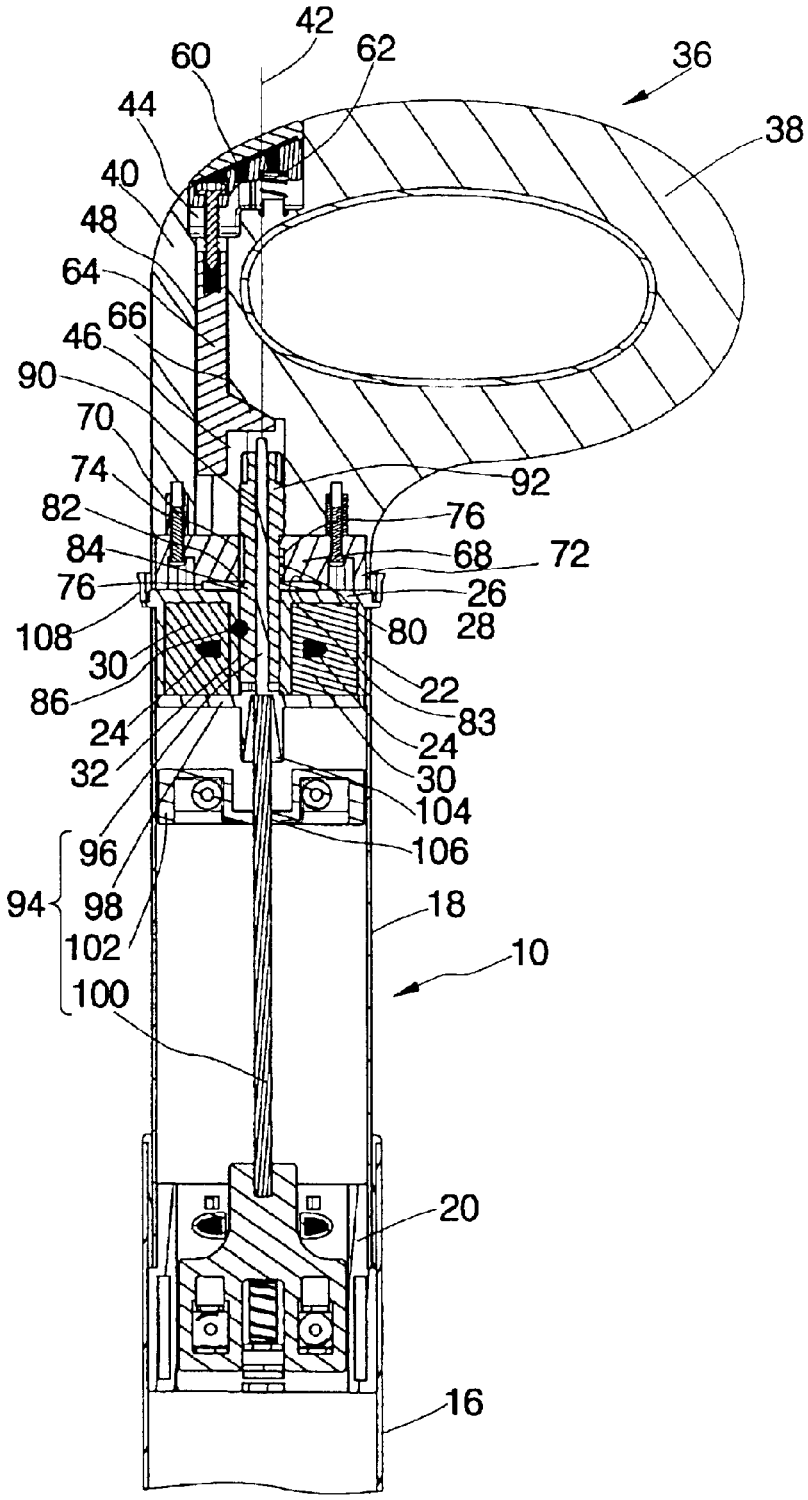
FIG. 4 is a sectional view of the handle and a part of the retractable tube of the preferred embodiment of the present invention, showing the lock device rested at the first position in which the handle is locked by the lock device.

As shown in FIG. 2, a luggage 1 has a case 2, two wheel assemblies 4 installed at the bottom of the case 2 and a single-tube retractable handle assembly 6 installed at the top of the case 2, wherein the single-tube retractable handle assembly 6 of the preferred embodiment of the present invention comprises:

A retractable tube 10, as shown in FIG. 3 and FIG. 4, is composed of four tubes 12, 14, 16 and 18 engaged with each other and three retraction controllers 20 installed in the tubes. The tubes 12, 14, 16 and 18 are substantially elliptical in cross-sections. The tubes 12, 14, 16 and 18 are retractable and the retraction controllers 20 are arranged to lock and unlock the tubes 12, 14, 16 and 18 so as to lock the tubes at least in retracted and extended positions and, when unlocked by movement of transmission device 94 in response to pressing of button 60 (described below in connection with FIG. 6), to permit movement of the tubes between the retracted and extending positions. The controllers 20 are conventional elements, you can find the detailed structure in U.S. Pat. No. 5,806,143, U.S. Pat. No. 6,357,080 or in other relative inventions. A tube plug 22 is secured at a distal end of the tube 18 that is the outer tube of the retractable tube 10 by two pins 24. The plug 22 has an engagement portion 26 at a top for engaging a handle-rotation locking device to lock the handle, as described below in connection with FIGS. 4 and 5, an annular flange 28 adjacent to the engagement portion 26, two blocks 30 received therein, a hole 32 from the top to a bottom and a side hole 34 communicated with the hole 30.

A handle 36 has a grip portion 38 and an axle portion 40 wherein the axle portion 40 has an axis of rotation 42 and the grip portion 36 located aside from the axis of rotation 42. The handle 36 has a recess 44 at a top of the axle portion 40, a chamber 46 at a bottom of the axle portion 40 and a hole 48 communicated with the recess 44 and chamber 46. A soft piece 58 is attached on the grip portion 38 to provide user a comfortable condition to grip it. A button 60 is received in the recess 44 and a spring 62 is mounted under the button 60 to urge the button 60 upwards. A rod 64 has a midsection received in the hole 48, a top section in the recess 44 and a bottom section in the chamber 46. A top end of the rod 64 is fixed to the button 60 to be shifted along with the button 60. The rod 64 further has a driving device 66 extended along a diameter orientation and received in the chamber 46. A handle plug 68 is secured at a bottom end of the chamber 46 by two screws 70. The handle plug 68 has an engagement portion 72 at a bottom thereof exposed out of the chamber 46. The handle plug 68 has a hole 74 extended through from a top to the bottom and a slot 76 beside the hole 74. A supporting device 78 has a rib 80 extended upwards and a hole 82 beside the rib 80. The supporting device 78 is received in a recess 83 at the bottom of the handle plug 68 with the rib 80 squeezed into the slot 76. The supporting device 78 enhances the strength of the handle plug 68.

A shaft 84 is received in the holes 32, 74 and 82 of the tube plug 22, the handle plug 68 and the supporting device 78. A pin 86 is inserted into the side hole 34 of the tube plug 22 and squeezed into a recess 88 of the shaft 84 to secure the shift 84 with the tube plug 22. The shaft 84 has a tunnel 90 and a head portion 92 at a top thereof received in the chamber 46 of the handle 36. The diameter of the head portion 92 is greater than the diameter of the hole 74 of the handle plug 68 to prevent the handle 36 from escaping the retractable tube 10. The shaft 84 serves as an axle of rotation to enable the handle 36 to be rotated relative to the retractable tube 10.

A transmission device 94 has a first bar 96, a connector 98, a second bar 100 and a stand 102. The first bar 96 has a midsection received in the tunnel 90 of the shaft 84, a top end extruded out of the shaft 84 and against the driving device 66 of the rod 64 and a bottom end connected with the connector 96. The connector 96 is located under the tube plug 22 having a slot 104 at a bottom thereof. The second bar 100 has a top end rested in the slot 104 and a bottom end against the controller 20. The stand 102 is received in the tube 18 having a hole 106 for the second bar 100 to pass through.

Figure 6:
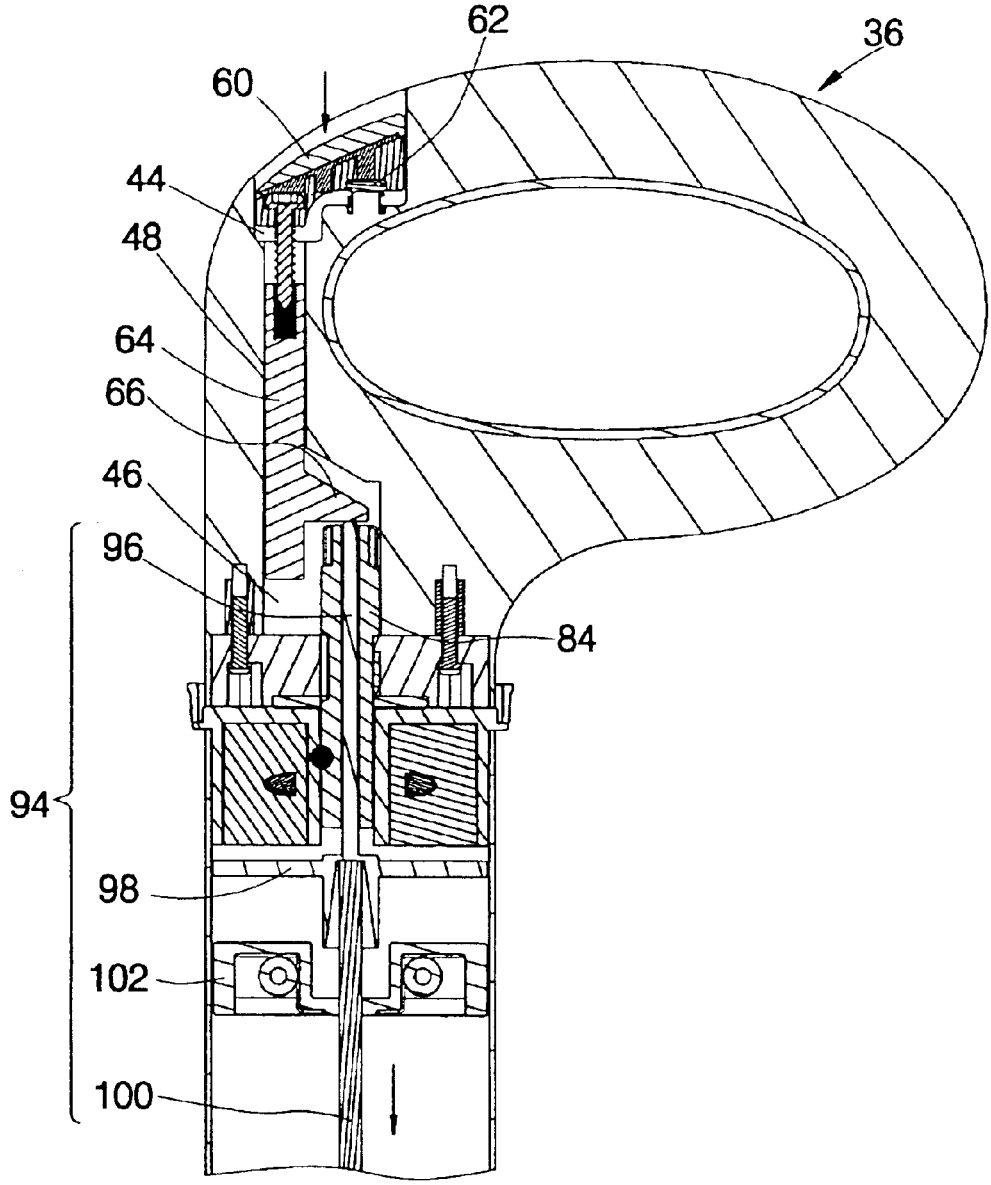
FIG. 6 is a sectional view similar to FIG. 4, showing the button is pressed to activate the controller in the tube.

As shown in FIG. 6, the button 60 is pressed downwards to force the rod 64 to shift downwards too, and then the driving device 66 presses the first bar to make the first bar 96, the connector 98 and the second bar 100 shift downwards, such that the second bar 100 activates the controller 20 to unlock the tubes 12, 14, 16 and 18. When the button 60 is no long pressed, a spring (not shown) in the controller 20 urges the second bar 100 upwards so that the elements described above will return their initial positions.

Figure 5:
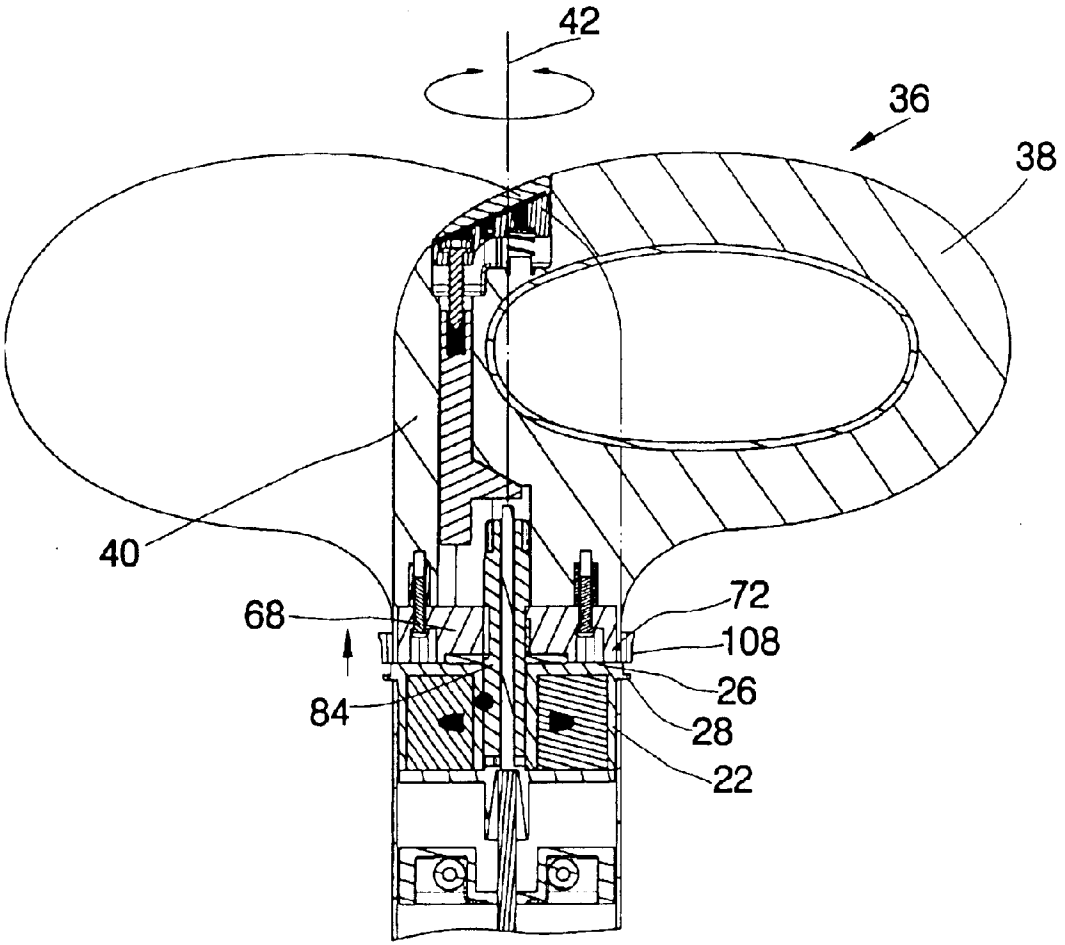
FIG. 5 is a sectional view following FIG. 4, showing the lock device being moved to the second position to release the handle, so that the handle is able to be rotated.

A lock device 108 is a ring in the present invention. The lock device 108 is installed at where a junction portion between the handle 36 and the retractable tube 10. The lock device 108 is moved between a first position, as shown in FIG. 4, in which the lock device 108 is engaged with both of the engagement portions 26 and 72 of the tube plug 22 and the handle plug 68, and a second position, as shown in FIG. 5, in which the lock device 108 is moved upwards and engaged only with engagement portions 72 of the handle plug 68. In the first position, the lock device 108 serves as a coupling making the handle 36 not rotated. In the second position, the lock device 108 is no longer coupled with the retractable tube 10 so that the handle 36 is rotated freely.

Figure 7:
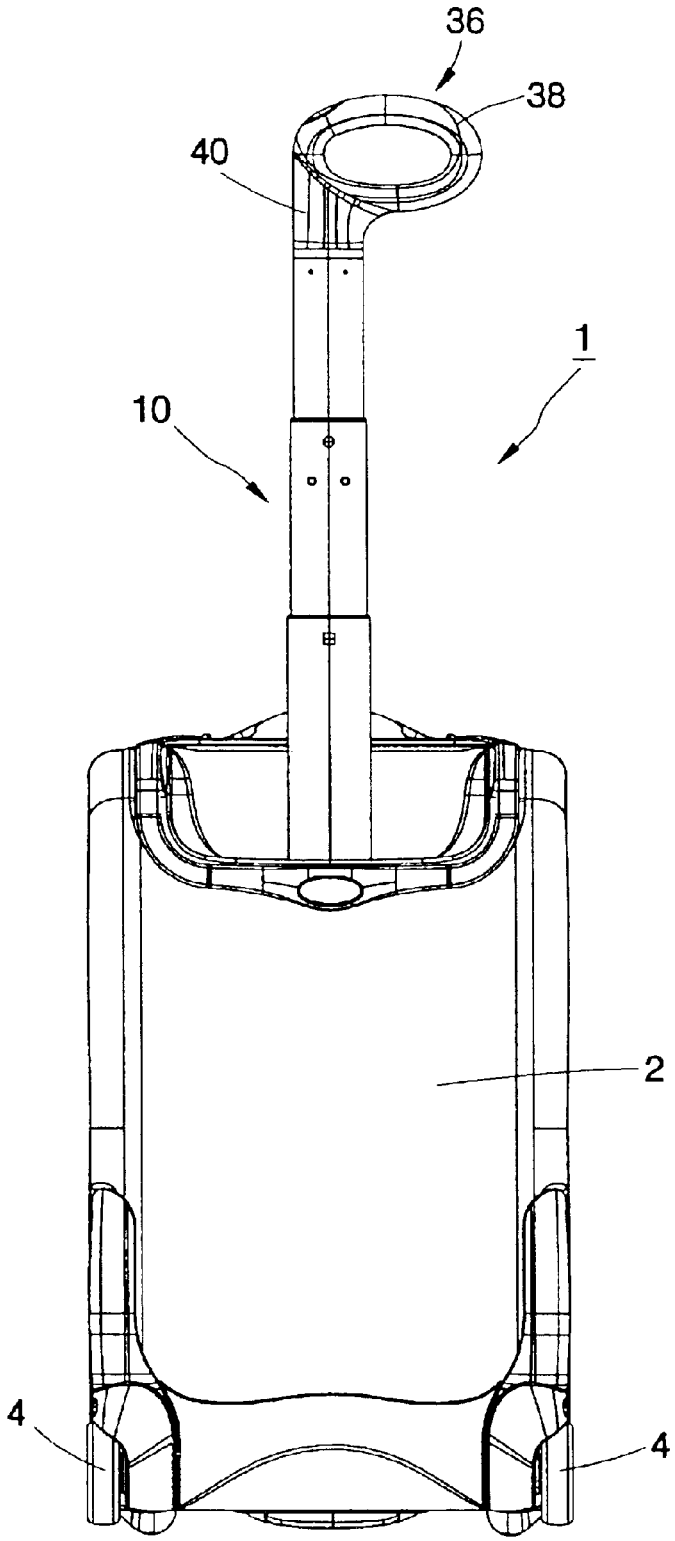
FIG. 7 is a back view of the luggage of the preferred embodiment of the present invention, showing the grip portion of the handle being rotated to right.
Figure 8:
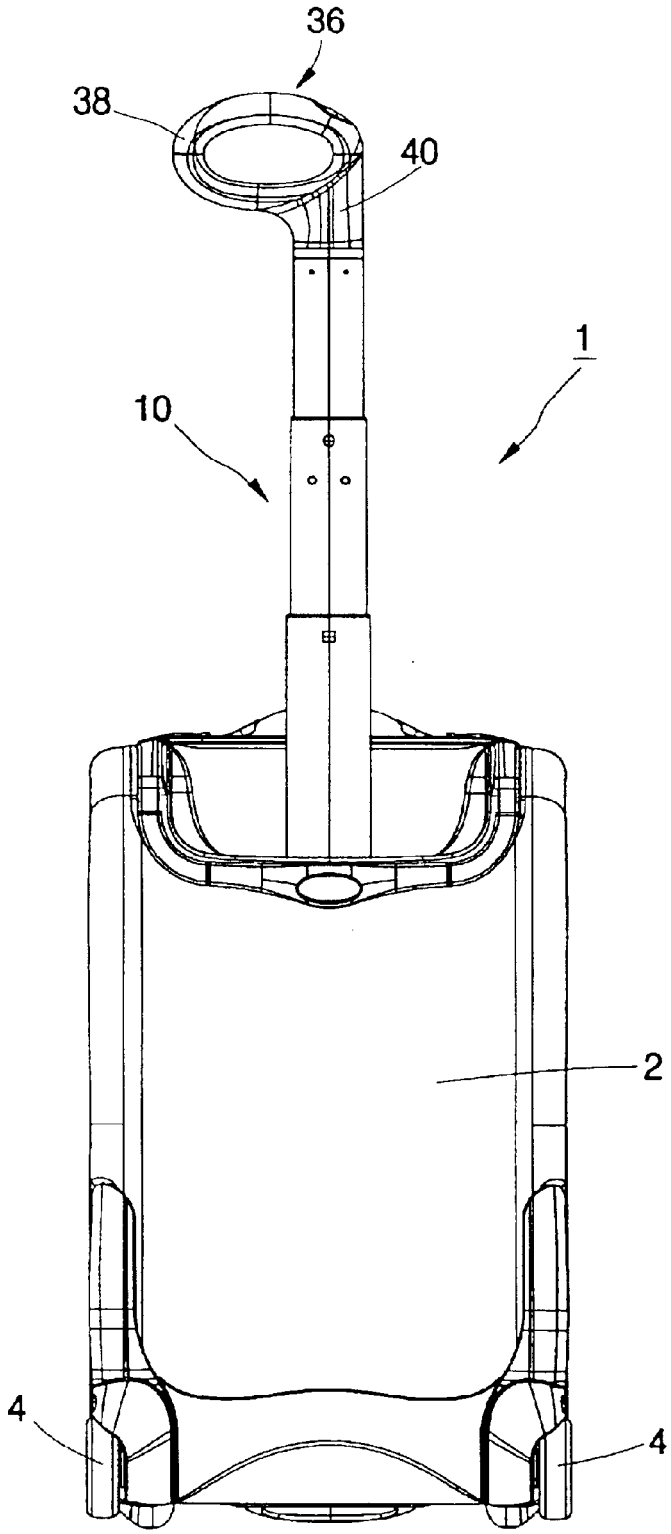
FIG. 8 is a back view of the luggage of the preferred embodiment of the present invention, showing the grip portion of the handle being rotated to left.

There are several characters of the present invention having to mentioned:

As shown in FIG. 7 and FIG. 8, the handle 36 is twisted with the grip portion 38 at a right side or a left side that facilitates user to hold the handle 36 by right hand or left hand so that user can pull the luggage 1 moving in a stable condition, no matter a right-handed user or a left-handed user.

The engagement portions 26 and 72 of the tube plug 22 and the handle plug 68 are elliptical in cross-sections and the lock device 108 has a sharp corresponding the engagement portions 26 and 72. In fact, the engagement portions 26 and 72 can have shapes of not round, such as triangle, rectangle, or polygon and so on, that serve same function of the elliptical engagement portions 26 and 72.

The lock device 108 is against the flange 28 of the tube plug 22 while it is moved to the first position. The flange 28 keeps the lock device 108 still in the first position.

The lock device 108 is disengaged with the engagement portions 26 of the tube plug 22 in the present invention while it is moved to the second position. The lock device 108 also can be designed for disengagement with the engagement portions 72 of the handle plug 68 while it is moved to the second position.

What is claimed is:

1. A retractable handle assembly, comprising:

a retractable tube including two or more tubes engaged with each other and at least a retraction controller received in the tube, the retraction controller being arranged to lock said tubes at least in an extended position and a retracted position, and to unlock said tubes for relative movement between the extended and retracted positions, wherein a first engagement portion is provided at an end of the retractable tube;

a handle having a grip portion arranged to be gripped by a user and an axle portion about which the handle is arranged to rotate relative to retractable tube, wherein a second engagement portion is provided at an end of the axle portion;

wherein a lock device is movably mounted on the retractable handle assembly at a junction between the retractable tube and the handle so as to engage both the first and second engagement portions to prevent rotation of said handle, and to disengage one of the first and second engagement portions to permit rotation of the handle relative to the retractable tube; and wherein the lock device is arranged to be moved between a first position, in which the lock device is engaged with both of the first and second engagement portions of the retractable tube and the handle to prevent rotation of the handle relative to said retraction tube, and a second position, in which the lock device only is engaged with one of the first and second engagement portions of the retractable tube and the handle such that the handle is rotated freely relative to the retractable tube.

2. The retractable handle assembly as defined in claim 1, wherein the retractable tube is further provided with a tube plug at a distal end of one of said tubes, the tube plug having the first engagement portion.

3. The retractable handle assembly as defined in claim 2, wherein the tube plug has a flange adjacent to the first engagement portion for retaining the lock device in said first position.

4. The retractable handle assembly as defined in claim 1, wherein the handle is provided with a handle plug, the handle plug having the second engagement portion.

5. The retractable handle assembly as defined in claim 4, wherein the handle plug is provided with a supporting device thereon which a rib is inserted into a slot on the handle plug.

6. The retractable handle assembly as defined in claim 1, further comprising a shaft coupling the handle with the retractable tube and serving as an axle of rotation of the handle.

7. The retractable handle assembly as defined in claim 6, wherein the shaft has a tunnel in which at least a portion of a transmission device is received and the transmission device has and end thereof connected with the retraction controller, said transmission device enabling a user to cause said retraction controller to unlock said tubes for relative movement.

8. The retractable handle assembly as defined in claim 1, further comprising a button provided on the handle and a transmission device having an end thereof connected to the button and the other end thereof to the retraction controller, said transmission device causing said retraction controller to unlock said tubes for relative movement when said button is pressed.

9. The retractable handle assembly as defined in claim 8, wherein the transmission device has a first bar having at least a portion received in axle portion of the handle to be coupled with the button, a second bar having at least a portion received in the tube of the retractable tube to be coupled with the retraction controller, and a connector for coupling the first bar with the second bar.

10. The retractable handle assembly as defined in claim 9, wherein the connector has a recess in which an end of the second bar is rested.

11. The retractable handle assembly as defined in claim 1, wherein the handle is provided with a soft piece at the grip portion.

12. The retractable handle assembly as defined in claim 1, wherein the first and second engagement portions of the retractable tube and the handle are non-rounded in cross-sections and the lock device has a corresponding shape.

13. The retractable handle assembly as defined in claim 1, wherein the handle has a recess at a top of the axle portion, a chamber at a bottom of the axle portion, a hole communicated with the recess and the chamber, a button rested in the recess, a spring urging the button and a rod having a midsection thereof received in the hole, a top end connected with the button and a bottom end received in the chamber.

14. The retractable handle assembly as defined in claim 13, wherein the rod has a driving device received in the chamber by which a transmission device is driven upon pressing the button to activate the retraction controller and thereby unlock said tubes for relative movement.

15. A luggage, comprising:

a case;

two wheel assemblies pivotally mounted on the case, and a single-tube retractable handle assembly mounted on the case;

wherein the retractable handle assembly comprises:

a retractable tube including two or more tubes engaged with each other and at least a retraction controller received in the tube, the retraction controller being arranged to lock said tubes in at least an extended position and a retracted position and to unlock said tubes for relative movement between the extended and retracted positions, wherein a first engagement portion is provided at an end of the retractable tube;

a handle having a grip portion arranged to be gripped by a user and an axle portion about which the handle is arranged to rotate relative to retractable tube, wherein a second engagement portion is provided at an end of the axle portion;

wherein a lock device is movably mounted on the retractable handle assembly at a junction between the retractable tube and the handle so as to engage both the first and second engagement portions to prevent rotation of said handle, and to disengage one of the first and second engagement portions to permit rotation of the handle relative to the retractable tube; and wherein the lock device is arranged to be moved between a first position, in which the lock device is engaged with both of the first and second engagement portions of the retractable tube and the handle to prevent rotation of the handle relative to said retraction tube, and a second position, in which the lock device only is engaged with one of the first and second engagement portions of the retractable tube and the handle such that the handle is rotated freely relative to the retractable tube.

* * * * *